US009855634B2

(12) United States Patent
Nauche et al.

(10) Patent No.: US 9,855,634 B2
(45) Date of Patent: Jan. 2, 2018

(54) DEVICE FOR CUTTING AN OPHTHALMIC LENS

(71) Applicant: ESSILOR INTERNATIONAL (COMPAGNIE GENERALE D'OPTIQUE), Charenton-le-Pont (FR)

(72) Inventors: Michel Nauche, Charenton-le-Pont (FR); Laurent Geysels, Charenton-le-Pont (FR)

(73) Assignee: ESSILOR INTERNATIONAL (COMPAGNIE GENERALE D'OPTIQUE), Charenton-le-Pont (FR)

( * ) Notice: Subject to any disclaimer, the term of this patent is extended or adjusted under 35 U.S.C. 154(b) by 83 days.

(21) Appl. No.: 14/772,596

(22) PCT Filed: Feb. 25, 2014

(86) PCT No.: PCT/FR2014/050406

§ 371 (c)(1),
(2) Date: Sep. 3, 2015

(87) PCT Pub. No.: WO2014/135761

PCT Pub. Date: Sep. 12, 2014

(65) Prior Publication Data

US 2016/0008945 A1 Jan. 14, 2016

(30) Foreign Application Priority Data

Mar. 8, 2013 (FR) ..... 13 52114

(51) Int. Cl.
*B24B 9/14* (2006.01)
*B24B 47/22* (2006.01)

(52) U.S. Cl.
CPC ..... *B24B 9/148* (2013.01); *B24B 9/14* (2013.01); *B24B 47/225* (2013.01)

(58) Field of Classification Search
CPC ..... B24B 47/225; B24B 9/14; B24B 9/148
See application file for complete search history.

(56) References Cited

U.S. PATENT DOCUMENTS 7,507,142 B2 * 3/2009 Shibata ..... B24B 9/14 408/103
2006/0178086 A1 * 8/2006 Shibata ..... B24B 9/14 451/6

(Continued)

FOREIGN PATENT DOCUMENTS

EP 1 679 153 A1 7/2006
EP 1679153 A1 * 7/2006 ..... B24B 9/14

(Continued)

OTHER PUBLICATIONS

International Search Report, dated Apr. 28, 2014, from corresponding PCT application.

*Primary Examiner* — Marc Carlson
(74) *Attorney, Agent, or Firm* — Young & Thompson

(57) ABSTRACT

A device (1) for cutting an ophthalmic lens (L1) to be mounted onto a spectacle frame, includes: elements (10) for locking and rotating the ophthalmic lens about a locking axis (A1); a tool holder which supports at least one first tool (60) rotatable about a rotational axis (A2) and a second tool (80) rotatable about a finishing axis (A6) and which has a spacing mobility (ESC) for the spacing apart thereof from the locking axis, a shifting mobility (TRA) for the axial positioning thereof along the locking axis, and a pivoting mobility (PIV) for adjusting the orientation of the rotational axis relative to the locking axis; and elements for controlling the three mobilities of the tool holder. The rotational and finishing axes are separate from one another.

14 Claims, 6 Drawing Sheets

(56) References Cited

U.S. PATENT DOCUMENTS

Figure 1:
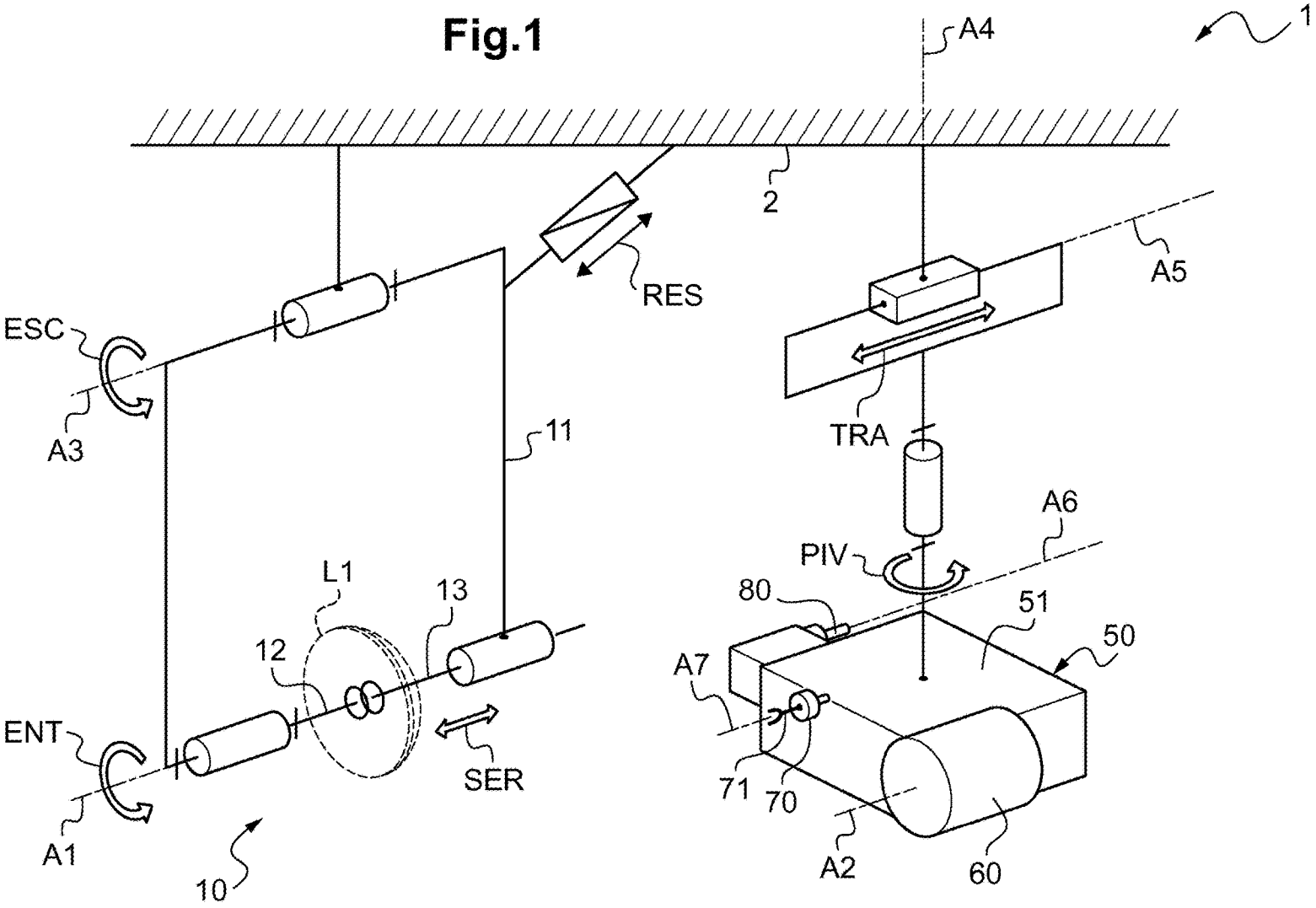

| | | | | |
|---|---|---|---|---|
| 2006/0217036 | A1* | 9/2006 | Meunier | B24B 27/0076 451/5 |
| 2010/0093265 | A1* | 4/2010 | Lemaire | B24B 9/14 451/294 |
| 2010/0247253 | A1* | 9/2010 | Shibata | B24B 9/148 408/3 |

FOREIGN PATENT DOCUMENTS

| | | | |
|---|---|---|---|
| FR | 2 852 878 | A1 | 10/2004 |
| FR | 2 906 746 | A1 | 4/2008 |

* cited by examiner

Fig.6A
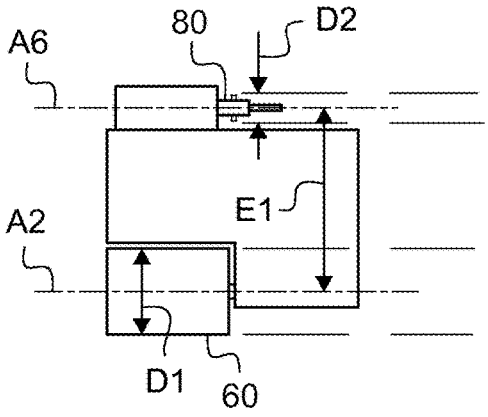
Fig.6B
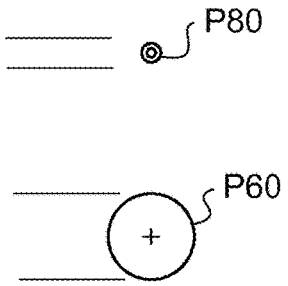
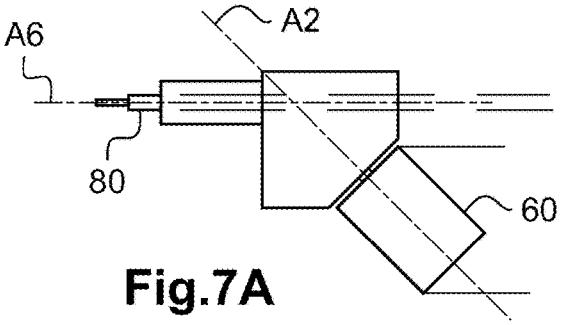
Fig.7A
Fig.7B
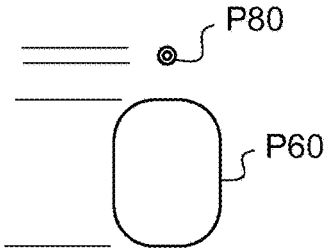
Fig.8A
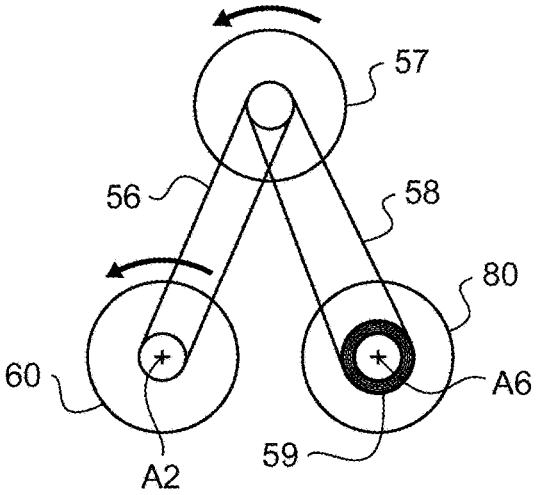
Fig.8B
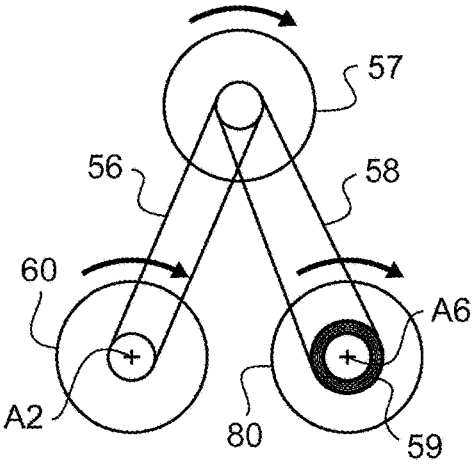

Fig.9A
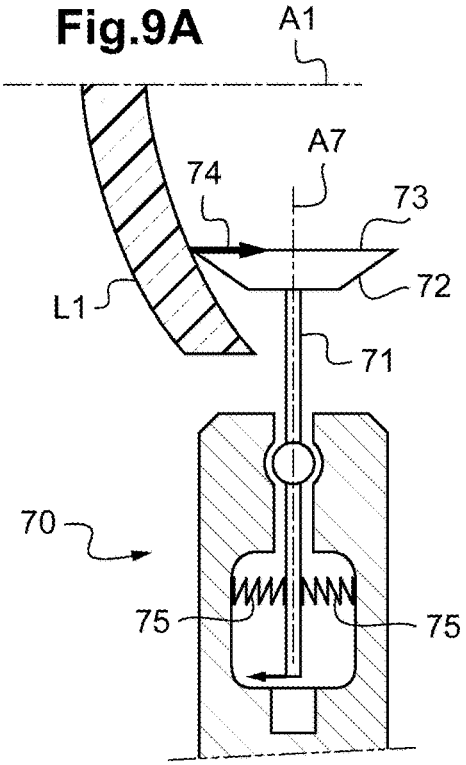
Fig.9B
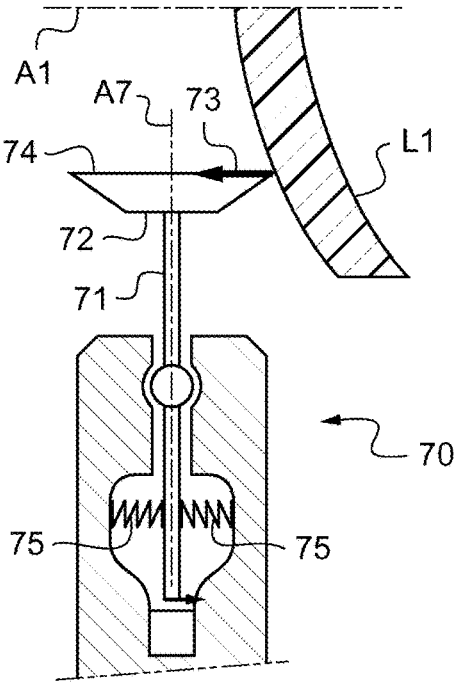
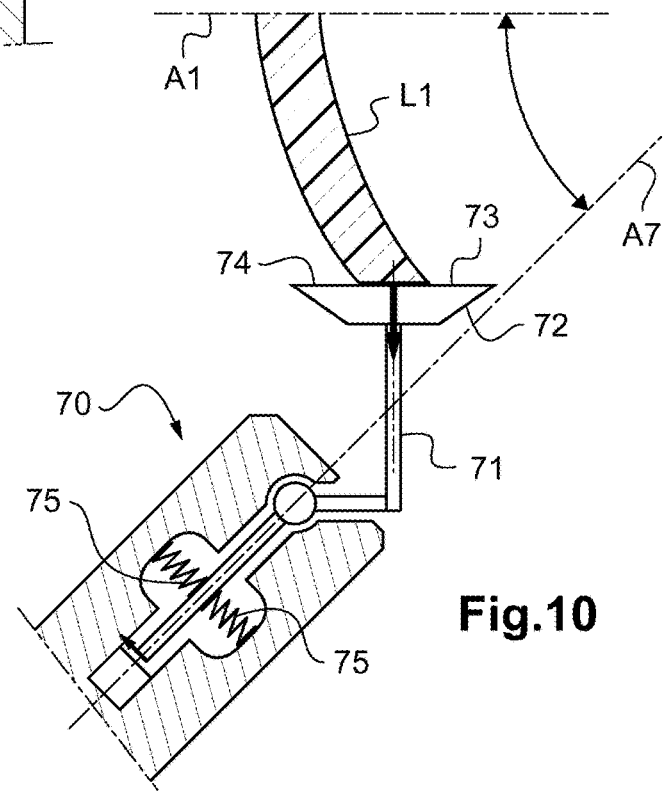
Fig.10

DEVICE FOR CUTTING AN OPHTHALMIC LENS

TECHNICAL FIELD OF THE INVENTION

The present invention relates in general to the trimming of an ophthalmic lens so that it can be mounted on a spectacles frame.

It relates more particularly to a trimming device comprising:

- rotation blocking and driving means for blocking and driving the rotation of the ophthalmic lens about a blocking axis,
- a tool holder which carries a first tool able to rotate about a rotational axis and a second tool able to rotate about a finishing axis and which is able to move with respect to said blocking and driving means with three types of mobility, these being:
  - a separation mobility for adjusting the radial separation of said first and second tools from the blocking axis,
  - an offsetting mobility for adjusting the axial position of said first and second tools with respect to said blocking and driving means on the blocking axis, and
  - a mobility in pivoting about a pivot axis transverse or orthogonal to the blocking axis, for adjusting the orientation of said rotational axis and said finishing axis with respect to said blocking axis, and
- means of controlling the three mobilities of the tool holder with respect to the blocking and driving means.

It also relates to a method of using such a trimming device.

BACKGROUND

Document EP 1 679 153 discloses a trimming device of the aforementioned type, in which the rotation clamping and driving means for clamping and driving the rotation of the lens comprise two coaxial shafts designed to sandwich the ophthalmic lens.

The trimming device described in that document comprises a set of grinding wheels for roughing and chamfering the lens and two feeler rods respectively intended to come into contact with the front and rear optical faces of the lens in order to measure the geometry thereof.

The set of grinding wheels and the two feeler rods are for that reason each equipped with drive means and with measurement means which are specific to them.

In that document, the tool holder of the trimming device comprises a support flanked, on one side, by a grooving wheel (the "first tool") and, on the other side, by a drill bit (the "second tool"). These two finishing tools can therefore be selected by causing the support to pivot through 180 degrees about the axis of pivoting using drive means specific to it.

One disadvantage of this device is that it comprises a great many drive means, to the detriment of its cost of manufacture and assembly and to the detriment of its bulk.

The major disadvantage of this device is that the tool holder is of such a bulk that the grooving wheel and the drill bit cannot be brought as close as would be desired to the ophthalmic lens clamping shafts. As a result, when the lens is of small height, it may prove to be impossible to groove the lens around its entire contour or to drill a hole in it, because the tool holder comes into contact with the clamping shafts.

The applicant company has also observed that, even when the bulkiness of these tool holders is reduced, it might not be possible to bring the drill bit as close as might be desired to the lens clamping shafts. Specifically, since the diameter of the grooving wheel is greater than that of the drill bit it may happen that the grooving wheel comes into contact with the clamping shafts before the drill bit reaches the desired position.

OBJECT OF THE INVENTION

In order to overcome the aforementioned disadvantage of the prior art, the present invention proposes a novel trimming device in which the first and second tools are positioned differently.

More specifically, the invention proposes a trimming device as defined in the introduction, in which said rotational axis and said finishing axis are distinct axes.

Thus, by virtue of the invention, the first and second tools are positioned relative to one another in such a way that when one tool is selected for machining the lens, the other tool does not interfere with the lens clamping shafts, thereby allowing the lens to be machined closer to the shafts that clamp it.

Advantageously, the tool holder also carries measurement means for measuring the geometry of the ophthalmic lens, and the control means are designed to select the measurement means or one of said first and second tools by controlling the mobility in pivoting of the tool holder with respect to the blocking and driving means so as to bring said measurement means or one of said first and second tools into position for measuring or machining said ophthalmic lens.

Thus, the tool holder drive means not only enable the tools to be positioned facing the ophthalmic lens in such a way as to trim same, but also enable the measurement means to be positioned facing the lens so as to measure the geometry thereof.

This design, which reduces the number of drives used, therefore offers the advantage of being less expensive and less bulky.

Other advantageous and nonlimiting features of the trimming device according to the invention are as follows:

- with the first tool having an outside diameter greater than the outside diameter of the second tool, the projections of the working surfaces of said first and second tools in a plane orthogonal to the finishing axis are at least partially disjointed;
- said rotational axis and said finishing axis are mutually parallel;
- said rotational axis and said finishing axis are inclined relative to one another;
- said first and second tools are driven in rotation respectively about the rotational axis and about the finishing axis by one and the same motor, at different rotational speeds;
- said first tool comprises at least one roughing grinding wheel;
- said first tool comprises at least one finish-grinding wheel;
- said second tool comprises a grooving wheel and/or a chamfering wheel and/or a drill bit and/or a milling cutter;
- the tool holder and the blocking and driving means are mounted with the ability to move on one and the same chassis element;
- said separation mobility is obtained by a mobility in pivoting of said blocking and driving means with respect to a chassis element about a retraction axis parallel to the blocking axis;

the offsetting mobility is a translational mobility of said tool holder with respect to a chassis element along a transfer axis parallel to the blocking axis; and said measurement means comprise a feeler fitted with a feeler tip designed to come to bear against at least one of the optical faces of the ophthalmic lens.

The invention also relates to a method for controlling the mobilities of a tool holder with respect to blocking and driving means of a machining device as aforementioned, comprising steps of:

selecting a first nose of the feeler by controlling the mobility in pivoting and in translation in such a way as to bring this first nose to face a first optical face of the ophthalmic lens, measuring the geometry of a first contour situated on said first optical face by coordinated control of the rotation mobility of the blocking and driving means and of the separation mobility of the tool holder, selecting a second nose of the feeler by controlling the mobility in pivoting and in translation so as to bring this second nose to face a second optical face of the ophthalmic lens, measuring the geometry of a second contour situated on said second optical face by coordinated control of the rotation mobility of the blocking and driving means and of the separation mobility of the tool holder, selecting one of said first and second tools by controlling the mobility in pivoting in such a way as to bring this tool to face the edge face of the ophthalmic lens, trimming the ophthalmic lens by coordinated control of the rotation mobility of the blocking and driving means and the separation mobility and offsetting mobility of the tool holder.

Advantageously, during the trimming step, the mobility of the tool holder in pivoting and in translation is controlled according to the measured geometries of said two contours.

DETAILED DESCRIPTION OF ONE EMBODIMENT

The description which will follow with reference to the attached drawings, given by way of nonlimiting examples, will make it easy to understand what the invention consists of and how it may be embodied.

Figure 2:
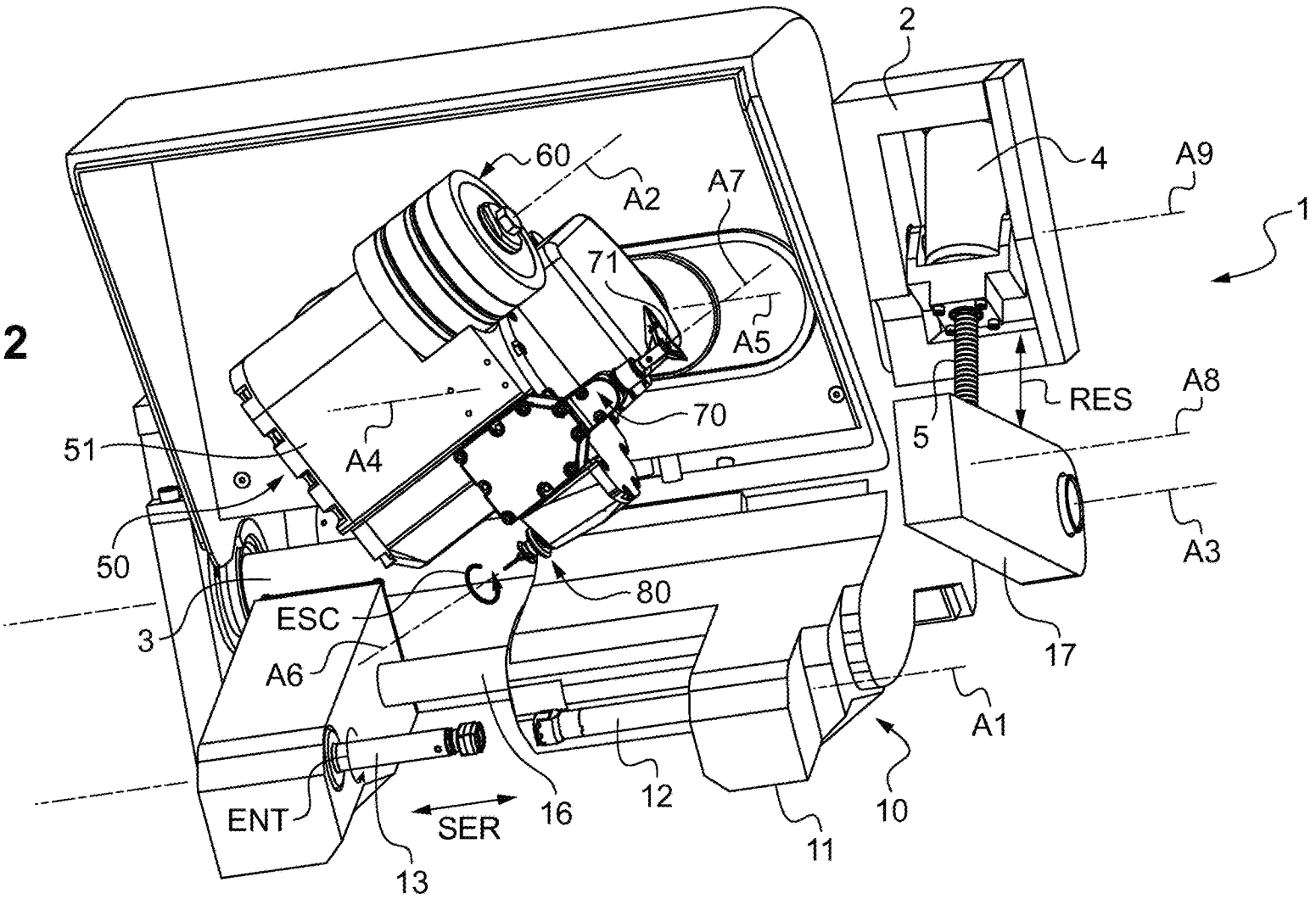
Figure 3:
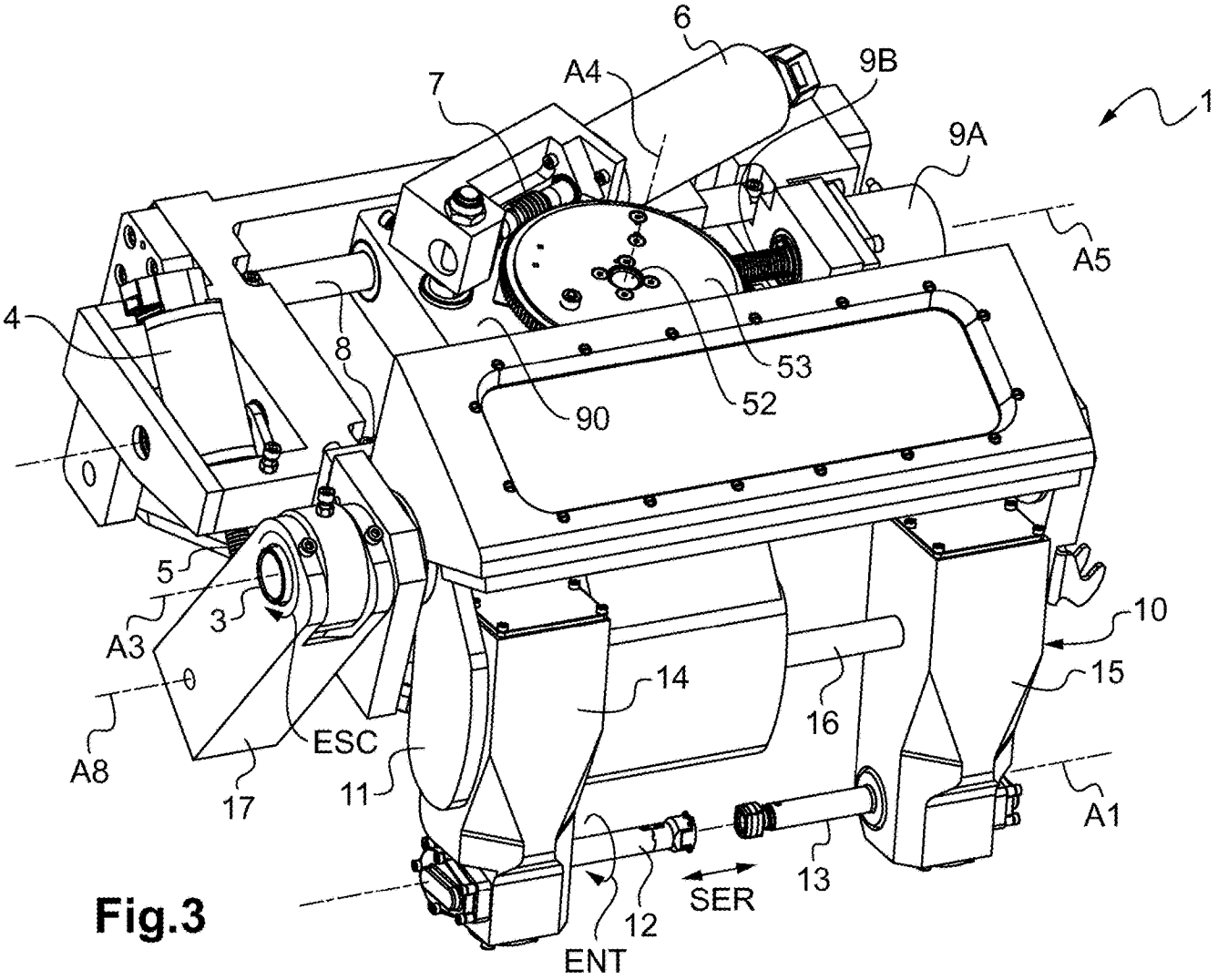
Figure 4:
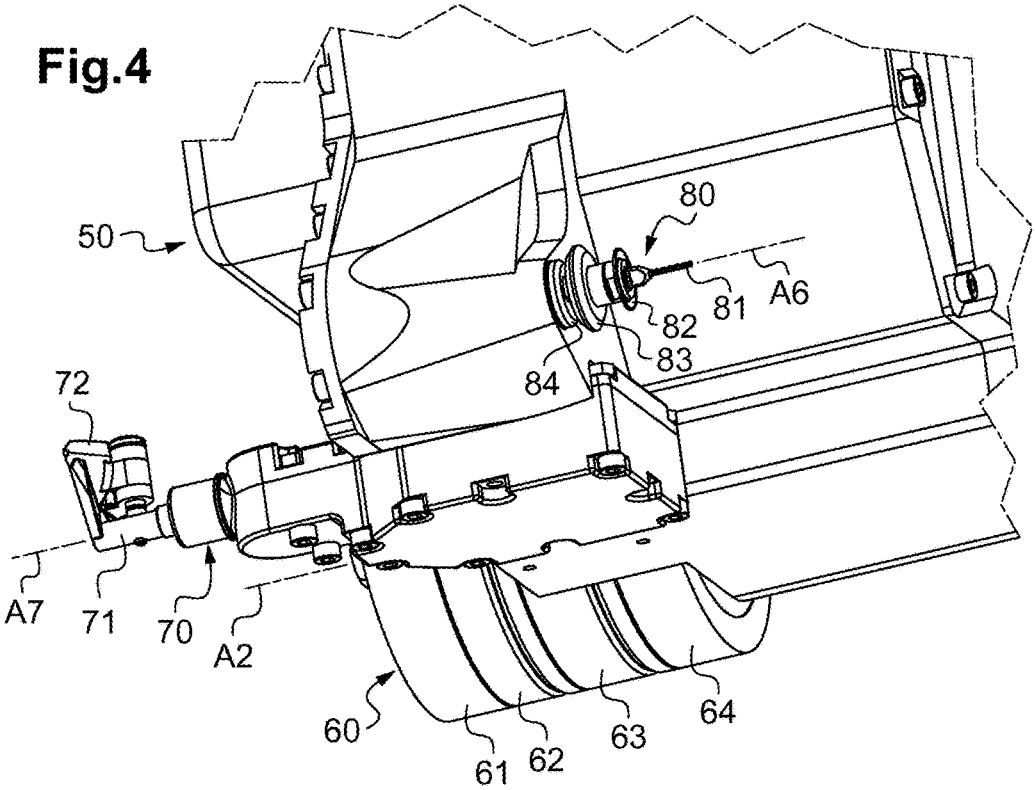
Figure 5:
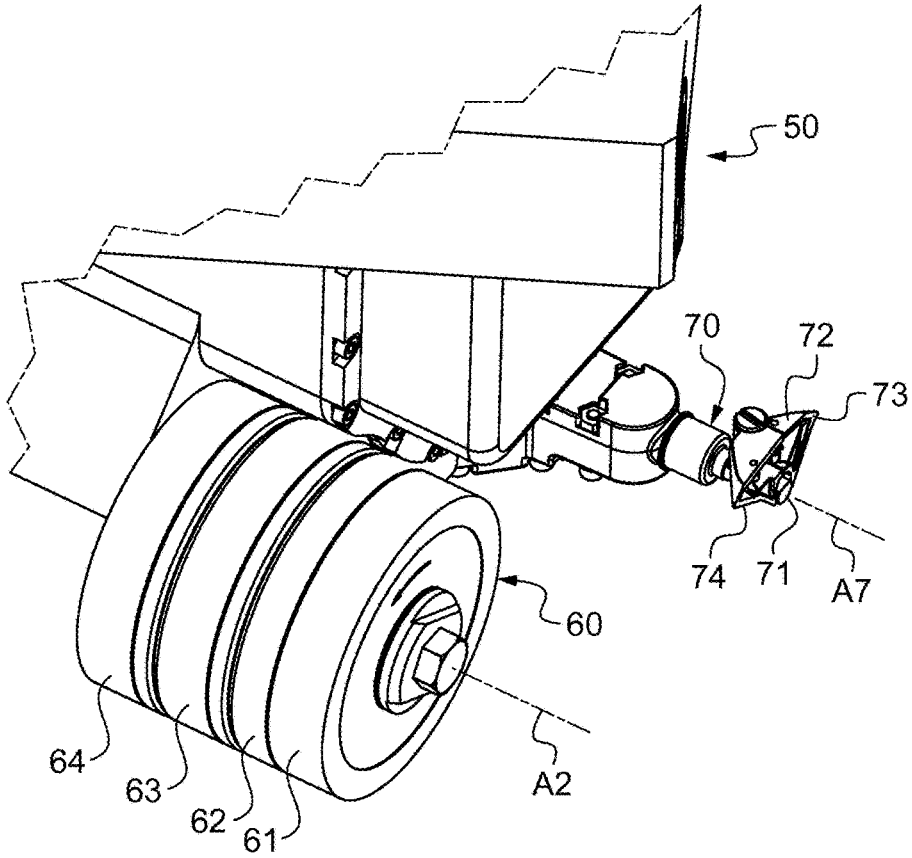

In the attached drawings:

FIG. 1 is a diagram illustrating the various mobilities of the components of the trimming device according to the invention, FIGS. 2 and 3 are schematic perspective views of the trimming device of FIG. 1, depicted without its lower chassis, from two different viewpoints, FIGS. 4 and 5 are detailed views of the feeler and of the machining tools of the trimming device of FIG. 1, FIGS. 6A and 7A are schematic views of two embodiments of the tool holder of the trimming device of FIG. 1, FIGS. 6B and 7B are plan views of the projections of the working surfaces of the tools of the tool holders of FIGS. 6A and 7A, FIGS. 8A and 8B are schematic views of the main motor and of the two tools of the tool holder of the trimming device of FIG. 1, FIGS. 9A and 9B are schematic views of the feeler of the trimming device of FIG. 1, bearing one against each of the two optical faces of an ophthalmic lens, and FIG. 10 is a schematic view of an alternative form of embodiment of the feeler of the trimming device of FIG. 1, bearing against the edge face of an ophthalmic lens.

A trimming device 1 according to the invention is depicted very schematically in FIG. 1.

The trimming device according to the invention could be produced in the form of various material cutting or removal machines able to modify the initial contour of an ophthalmic lens L1 in order to adapt it to suit that of a surround of a selected spectacles frame.

Here, as depicted in FIG. 1, the trimming device consists of an automatic, commonly referred to as a numerical control, grinding machine 1.

This grinding machine in this particular instance comprises:

a fixed lower chassis (not depicted), an upper chassis 2 which with the lower chassis delimits a housing to accommodate the various components of the grinding machine and which is pivot mounted on the lower chassis in order to allow access to these various elements, rotation blocking and driving means 10 for blocking and driving the rotation of the ophthalmic lens L1 about a blocking axis A1, which in practice is a horizontal axis, a tool holder 50 which carries at least one tool 60 wedged in rotation about a rotational axis A2, and measurement means 70 for measuring the geometry of the ophthalmic lens L1, and means for controlling the positions of these various elements.

In this instance, the rotation blocking and driving means 10 and the tool holder 50 are mounted on the upper chassis 2, making these elements easier to access for installing an ophthalmic lens that is to be trimmed or for repairing the grinding machine.

Rotation Blocking and Driving Means

As depicted in FIG. 1, the rotation blocking and driving means 10 for blocking and driving the rotation of the ophthalmic lens L1 comprise a rocker 11 which is mounted with mobility to rotate on the upper chassis 2 about a retraction axis A3 parallel to the blocking axis Al. This mobility of the rocker 11 is referred to as the retraction mobility ESC. It allows the ophthalmic lens L1 to be brought closer to or further away from the tool holder 50.

The rotation blocking and driving means 10 also comprise two shafts 12, 13 aligned with one another along the blocking axis A1 and mounted with mobility to rotate about this blocking axis A1. This mobility of the shafts 12, 13 is referred to as the drive mobility ENT. It allows any point of the edge of the ophthalmic lens L1 to be offered up to the tool holder 50.

A first of the two shafts 12 is fixed in terms of translation along the blocking axis A1 whereas the second of these two shafts 13 on the other hand is mounted with translational mobility along the blocking axis A1 with respect to the first shaft 12. This mobility of the shaft 13 is referred to as the clamping mobility SER. It allows the ophthalmic lens L1 to be clamped in axial compression and blocked between these two shafts 12, 13.

In concrete terms, in the embodiment of the grinding machine 1, that has been depicted in FIGS. 2 and 3, the design of the rotation blocking and driving means 10 is as follows.

The upper chassis 2 carries a main shaft 3 the axis of which coincides with the retraction axis A3, on which shaft the rocker 11 is mounted.

As FIG. 3 clearly shows, this rocker 11 comprises two parallel legs 14, 15 mounted with mobility to rotate on the main shaft 3 about the retraction axis A3, so as to achieve the retraction mobility ESC.

The two shafts 12, 13 are therefore mounted with mobility to rotate on these legs 14, 15 so as to achieve the drive mobility ENT to drive the rotation of the lens about the blocking axis A1. These legs 14, 15 internally house synchronized drive means for actuating this drive mobility ENT.

One of the two legs 14, 15 is also mounted with the ability to slide on the main shaft 3 along the axis A3 in order to achieve the clamping mobility SER whereby the ophthalmic lens L1 is clamped in axial compression between the two shafts 12, 13. An actuator 16 is therefore provided between these two legs 14, 15 to actuate this clamping mobility SER and ensure that the legs 14, 15 remain perfectly parallel.

The rocker 11 is also flanked by a link rod 17 one end of which is fixed to one of the legs 14 and the other end of which carries a tapped nut (not visible in the figures).

The tapped nut is articulated to the link rod 17 so as to pivot about an axis A8 parallel to the blocking axis A1. It is in screw engagement with a threaded rod 5 rotationally driven by a motor 4. This motor 4 is itself mounted with mobility to rotate on the upper chassis 2 about an axis A9 parallel to the blocking axis A1.

Thus, when the motor 4 causes the threaded rod 5 to turn, the tapped nut moves translationally along the threaded rod 5 with a restitution mobility RES. In that way, this ball screw-nut system causes the rocker 11 assembly to rock according to the retraction mobility ESC.

Tool Holder

As depicted schematically in FIG. 1, the tool holder 50 comprises a multifunction module 51 which is mounted with the ability to move on the upper chassis 2 with a translational mobility and a rotational mobility.

The translational mobility thereof, referred to as the transfer mobility TRA, allows the multifunction module 51 to move along a transfer axis A5 parallel to the blocking axis A1 so as to adjust the axial position of the tool holder 50 along the blocking axis A1.

The rotational mobility thereof, referred to as to the mobility in pivoting PIV, allows the multifunction module 51 to pivot about a pivot axis A4 perpendicular to the blocking axis A1 so as to offer up one or other of its faces to the ophthalmic lens L1 held between the two shafts 12, 13.

In concrete terms, in the embodiment of the grinding machine 1 that has been depicted in FIGS. 2 and 3, the design of the tool holder 50 is as follows.

As FIG. 3 shows, the upper chassis 2 bears two shafts 8 with axes parallel to the transfer axis A5, on which shafts is mounted a slider 90 supporting the multifunction module 51.

The multifunction module 51 of the tool holder 50 has a solid shape, parallelepipedal overall, with an upper face facing toward the slider 90, an opposite lower face, and four lateral faces.

The slider 90 which here has a parallelepipedal shape has two through-wells fitted over the two shafts 8 in order to achieve the transfer mobility TRA of the multifunction module 51 on the upper chassis 2 along the transfer axis A5. A motor 9A fixed to the upper chassis 2 is intended to drive the rotation of a ball screw nut 9B which is engaged with a tapped bore provided in the slider 90, so as to actuate this transfer mobility TRA.

The multifunction module 51 bears, projecting from its upper face, a shaft 52 which is engaged through a bore made in the slider 90 in order to provide the mobility in pivoting PIV of the multifunction module 51 with respect to the upper chassis 2 about the pivot axis A4. A motor 6 fixed to the slider 90 drives rotation of a worm 7 which is in mesh with a wheel 53 fixed at the upper end of the shaft 52, so as to actuate this mobility in pivoting PIV.

Tools and Measurement Means As FIG. 1 shows, the multifunction module 51 of the tool holder 50 carries two tools 60, 80 and, in this instance, measurement means 70 for measuring the ophthalmic lens L1.

As FIG. 6 shows, the first tool in this instance is a grinding wheel 60 and the second tool is a finishing accessory 80. The finishing accessory 80 has a maximum outside diameter D2 which is less than the maximum outside diameter D1 of the grinding wheel 60.

According to the invention, the grinding wheel 60 is mounted with the ability to rotate on the multifunctional module 51 about a rotational axis A2 which is distinct from the finishing axis A6 about which the finishing accessory 80 is mounted with the ability to rotate.

For preference, the projections P60, P80 of the working surfaces of the grinding wheel 60 and of the finishing accessory 80 in a plane of projection orthogonal to the finishing axis A6 are at least partially disjointed.

In that way, when the finishing accessory 80 moves in closer to the lens L1 in order to machine same, in the immediate vicinity of the two shafts 12, 13 that clamp this lens, the grinding wheel 60 remains distant from these two shafts 12, 13.

In this particular instance, as FIGS. 1 and 6A show, the rotational axis A2 and the finishing axis A6 are mutually parallel and, as FIG. 6B shows, the projections P60, P80 of the working surfaces of these tools in the plane of projection are entirely disjointed.

As an alternative, provision could be made for the projection P80 of the finishing accessory 80 to be partially overlapped by the projection P60 of the grinding wheel 60. However, in order for this overlap to be incomplete, the diameters D1, D2 of the tools and the distance between centers El between the rotational axis A2 and the finishing axis A6 need to be chosen such that:

$$D1<D2+2.E1$$

As yet another alternative, as FIG. 7A shows, provision could be made for the rotational axis A2 and finishing axis A6 to be inclined relative to one another.

In such an alternative form, it is preferable for these two axes, the rotational axis A2 and the finishing axis A6, not to be coplanar.

As depicted in FIG. 7B, the projections P60, P80 of the working surfaces of these tools in the plane of projection are entirely disjointed. The situation could, of course, be otherwise, so long as the projection P80 of the finishing accessory 80 is only partially covered by the projection P60 of the grinding wheel 60.

In this instance, in order for there not to be a complete overlap, it is preferable for the grinding wheel 60 not to intersect the finishing axis A6.

As schematically depicted in FIG. 1, the multifunction module 51 of the tool holder 50 comprises just a cylindrical grinding wheel 60. In practice, as FIG. 5 clearly shows, it rather comprises a set of grinding wheels 60 mounted coaxially on the same axis, each grinding wheel being used for a specific operation in the machining of the ophthalmic lens L1.

This set of grinding wheels 60 is in this instance mounted to pivot about the grinding wheel axis A2 (which is orthogonal to the pivot axis A4) and is duly rotationally driven about this axis by a motor 57 housed inside the multifunction module 51.

The set of grinding wheels 60 here comprises two roughing wheels 61, 64 with the same shape of a cylinder of revolution about the grinding wheel axis A2, used for roughing the ophthalmic lens L1, which means to say for bringing the circular initial contour thereof to an intermediate contour close to the desired final contour. These two roughing wheels 61, 64 have different grit sizes, optimized for machining lenses made of different materials.

The set of grinding wheels 60 also here comprises at least one finishing wheel (for chamfering and/or polishing and/or grooving the lens). The finishing wheels differ from the roughing wheels notably in terms of their grit size (below 100 microns) which is much finer than that of the roughing wheels (of the order of 150 to 500 microns).

It more specifically in this instance comprises two chamfering wheels 62, 63 with the same shape of revolution about the grinding wheel axis A2, each having a chamfering groove in the form of a dihedron. These two grinding wheels make it possible to create a nesting rib (or "chamfer") along the edge face of the lens, to allow it to fit into a rim of a rimmed spectacles frame. These two chamfering wheels 62, 63 have different grit sizes, optimized for machining lenses made of different materials.

The finishing accessory 80 for its part is more specifically depicted in FIG. 4.

It is supported by a chuck 84 mounted to pivot about the finishing axis A6 (orthogonal to the pivot axis A4) and duly rotationally driven by a motor 57 housed inside the multifunction module 51.

The finishing accessory 80 in particular comprises a mini chamfering wheel 83, a mini grooving wheel 82 and a drill bit 81.

The mini chamfering wheel 83 has a central part that is cylindrical of revolution about the finishing axis A6, flanked by two conical lateral parts likewise of revolution about the finishing axis A6. These conical lateral parts are configured to machine the sharp edges of the ophthalmic lens L1.

The mini grooving wheel 82 has the form of a disk of small thickness. It is configured to make a nesting groove along the edge face of the ophthalmic lens L1, to allow it to nest in a bridge of a half-rimmed spectacles frame.

The drill bit 81 is for its part designed to drill holes in the ophthalmic lens, so that it can be mounted on a rimless spectacles frame. can As an alternative, provision may be made for this drill bit to be replaced by a milling cutter suited to cutting the lens out from solid (by cutting rather than by removal of material).

Again as an alternative it is possible to provide both a drill bit and a milling cutter on the multifunction module 51.

The mobility in pivoting PIV of the multifunction module 51 then allows these various tools 60, 81, 82, 83 to be inclined by a variable angle with respect to the ophthalmic lens L1, this notably making it possible to incline the insetting rib along the edge of the lens or allowing the lens to be drilled along an axis normal to the plane tangential to the front face of the lens at the point of drilling.

Here, as FIGS. 8A and 8B show, the grinding wheel 60 and the finishing accessory 801 are rotationally driven about their rotational axis A2 and finishing axis A6 by one and the same single motor 57, at different rotational speeds.

These rotational speeds are chosen notably according to the material of the lens L1 that is to be machined and the material of the tool used to do so.

In this instance, the motor 57 on the one hand drives the grinding wheel 60 by means of a first transmission mechanism 56 and, on the other hand, drives the finishing accessory 80 by means of a second transmission mechanism 58. As depicted in FIGS. 8A and 8B, these are belt-drive transmission mechanisms, but of course this could be otherwise. It could, for example, be a gear transmission mechanism.

Whereas the first transmission mechanism 56 is a continuous-torque (i.e. non-disengageable) transmission mechanism, the second transmission mechanism 58 is a disengageable torque transmission mechanism.

In that way, it is possible when trimming the lens L1 using the grinding wheel 60 to disengage the finishing accessory 80, allowing the rolling bearings and seams associated with this finishing accessory 80 to be preserved.

For that, provision is made here for the second transmission mechanism 58 to comprise a free wheel. Thus, when it is desirable to use the grinding wheel 60, the motor 57 is controlled in such a way that its output shaft rotates in a first direction and drives the rotation of the grinding wheel (FIG. 8A) alone. By contrast, when it is desirable to use the finishing accessory 80, the motor 57 is controlled in such a way that its output shaft rotates in the opposite direction and drives the rotation of the grinding wheel 60 and the finishing accessory 80 (FIG. 8B). This inexpensive system proves to be particularly reliable.

As an alternative, provision could be made for the two transmission mechanisms to be disengageable, for example by providing a free wheel in each of them. In this way, when the output shaft of the motor is turning in one direction, it drives the rotation of the grinding wheel alone and when it is turning in the opposite direction, it drives the rotation of the finishing accessory alone.

The measurement means 70 which allow acquisition of the three-dimensional coordinates of points situated on at least one of the optical faces of the ophthalmic lens L1 are themselves more particularly depicted in FIG. 5.

Here they are designed to be able to capture the three-dimensional coordinates of a plurality of points that are characteristic of the shape of the final contour (to which the lens is to be trimmed) on each of the two optical faces of the ophthalmic lens L1.

Here, these measurement means are feeler means, which are therefore designed to come into contact with various points on the ophthalmic lens in order to capture the three-dimensional coordinates thereof.

As an alternative, provision could of course be made for these measurement means to be designed to take telemetry measurements from the ophthalmic lens L1, which means to say contactless measurements, for example using laser telemetry.

As FIGS. 4 and 5 show, these measurement means 70 here comprise a support rod 71 extending lengthwise along an axis A7 parallel to the rotational axis A2 and finishing axis A6, and fitted with a feeler tip 721 intended to come to bear against one or other of the optical faces of the ophthalmic lens L1.

As depicted in FIG. 5, this feeler tip 72 for this purpose comprises two identical noses 73, 74 pointing in directions that are symmetric about the axis A7, forming an obtuse angle, and which are thus designed one to feel one and the other to feel the other of the two optical faces of the ophthalmic lens L1.

As depicted in FIGS. 9A and 9B, the support rod 71 is mounted almost fixedly on the multifunction module 51 of the tool holder 50.

It has only mobility in rotation about a neutral position, of reduced amplitude (of the order of 1 degree on each side of this neutral position). Return means 75 (in this instance springs) are provided on each side of the support rod 71 to return it to the neutral position.

Thus, in order for the control means of the grinding machine 1 to be able to detect contact between the ophthalmic lens L1 and one of the noses 73, 74 of the feeler tip, a position sensor 76 is provided situated facing the internal end of the support rod 71 and able to detect any movement of this support rod 71.

Given the stiffness of the springs 75, this position sensor also makes it possible to determine the load applied by the feeler tip 72 to the ophthalmic lens L1.

In this way it is possible to feel the optical faces of the ophthalmic lens L1 while applying a reduced load thereto, so as to avoid deforming it and thus corrupting the measurements.

As an alternative, provision could also be made for the support rod to be mounted fixedly on the multifunction module of the tool holder and a strain gauge to be positioned on the shaft about which this multifunction module pivots (with the mobility PIV). Thus, by detecting torsion in this shaft using this strain gauge, the control means will be able to detect the contact of the feeler tip 72 with the ophthalmic lens L1.

Again as an alternative, as FIG. 10 shows, it may be conceivable for the measurement means 70 to be designed to feel the edge of the ophthalmic lens L1, in order for example to determine the shape of the contour of this lens and the exact position of this contour relative to the shafts 12, 13.

In this alternative form, the support rod will be elongated along the axis A7 and have an end which is bent relative to this axis A7, preferably by an angle of 45 degrees.

That way, the position sensor 76 will be able to detect contact of the feeler tip 72 both with one of the optical faces of the lens L1 and with the edge of the lens L1.

As FIGS. 1 and 2 clearly show, the measurement means 70, the finishing accessory 80 and the set of grinding wheels 60 are distributed about the periphery of the multifunction module 51 of the tool holder 50.

Thus, the mobility in pivoting PIV of the multifunction module 51 allows, depending on the angular position of this multifunction module 51 about the pivot axis A4, just one of these various elements 60, 70, 80 to be brought to face the ophthalmic lens L1 blocked between the two shafts 12, 13.

In this instance, the finishing accessory 80 and the set of grinding wheels 60 are notably situated opposite one another with respect to the pivot axis A4, on two opposite lateral faces of the multifunction module 51. The measurement means 70 for their part are situated on a third lateral face of the multifunction module 51, between the finishing accessory 80 and the set of grinding wheels 60.

Control Means

The control means are designed to provide positional control over the various mobilities of the grinding machine 1.

For that purpose they are implemented on an electronic and/or computerized control unit housed in the upper chassis 2.

They in particular provide control of:

- the actuator 16 for clamping the ophthalmic lens L1 in axial compression between the two shafts 12, 13 using the clamping mobility SER;
- the motors driving the rotation of the two shafts 12, 13, according to the drive mobility ENT;
- the motor 4 driving the pivoting of the rocker 11 according to the retraction mobility ESC;
- the motor 9A driving the translation of the slider 90 according to the transfer mobility TRA;
- the motor 6 driving the pivoting of the multifunction module 51 according to the mobility in pivoting PIV;
- the motor driving the rotation of the set of grinding wheels 60;
- the motor driving the rotation of the chuck 84.

Advantageously, these control means are notably designed to select the measurement means 70 or the finishing accessory 80 or the set of grinding wheels 60 by means of the pivoting PIV of the tool holder 50. Stated differently, the mobility in pivoting PIV is controlled by the control means in such a way as to bring the feeler tip 72 or the finishing accessory 80 or the set of grinding wheels 60 to face the lens so that it can perform its machining or measurement function.

Now, as was explained hereinabove, this mobility in pivoting PIV was already needed for correctly orienting the tools 60, 81, 82, 83 with respect to the ophthalmic lens L1. It will therefore be appreciated here that the addition of the lens feeling means to the multifunction module requires no additional drive.

The control unit also comprises acquisition means allowing the positions of the various mobile components of the grinding machine 1 to be captured. These acquisition means also make it possible to capture the magnitude of the load applied by the feeler tip 72 to the ophthalmic lens L1.

The grinding machine 1 finally comprises a man-machine interface which in this instance comprises a touch-sensitive screen. This man-machine interface allows the user to input numerical values on the screen in order to control the grinding machine 1 accordingly.

These control means allow four operations of blocking, feeling, roughing and finishing the ophthalmic lens L1 to be carried out under the control of the optician.

Blocking Operation

During the blocking operation, the optician takes hold of an ophthalmic lens L1 fitted with a blocking accessory then fits it between the two shafts 12, 13 of the grinding machine 1, taking care to position said blocking accessory correctly against the tip of one of the two shafts 12, 13. He then, using the touch-sensitive screen available to him, commands the axial clamping of the lens.

The blocking accessory allows the ophthalmic lens L1 to be positioned accurately between the two arms 12, 13 so that the control unit of the grinding machine 1 can determine the exact position of this lens.

The control unit may thus determine precisely the position of the final contour to which the lens is to be trimmed, in the frame of reference of the grinding machine 1.

Feeling Operation

At this stage, only the two-dimensional shape of this final contour is known.

Now, for reasons that will be explained later on this description, it is desirable to know the three-dimensional shapes of the projections of this final contour on each of the two optical faces of the ophthalmic lens L1.

To do that, the two optical faces of the lens need to be felt using the measurement means.

The feeling operation therefore consists in successively feeling the two optical faces of the ophthalmic lens L1 around the final contour, using the two noses 73, 74 of the feeler tip 72.

In concrete terms, the control unit therefore selects a first nose 73 of the feeler tip 72 by controlling the mobility in pivoting PIV and the translational mobility TRA of the multifunction module 51 so as to bring this first nose 73 into line with a first of the optical faces of the ophthalmic lens L1.

It then commands the retraction ESC and drive ENT movements in order to cause the rocker 11 and the shafts 12, 13 to pivot jointly so that the first optical face of the lens slides over the first nose 73 along the desired contour. These two movements are controlled in coordination with the transfer movement TRA, according to the detected position of the support rod 71, so that the first nose 73 applies a low but non-zero load to the ophthalmic lens L1, ensuring that the feeler tip 72 remains continuously in contact with the lens.

During this movement, the control unit captures the three-dimensional coordinates of a plurality of characteristic points of the shape of the projection of the final contour on the first optical face of the lens.

The control unit then selects the second nose 74 of the feeler tip 72 by controlling the mobility in pivoting PIV (over approximately 180 degrees) and the translational mobility TRA of the multifunction module 51, so as to bring this second nose 74 to face the second optical face of the ophthalmic lens L1.

It then once again commands the movements of retraction ESC, drive ENT and transfer TRA in order to capture the three-dimensional coordinates of a plurality of characteristic points of the shape of the projection of the final contour on the second optical face of the lens.

Roughing Operation

To rough out the ophthalmic lens L1, use is made of one or other of the two roughing wheels 61, 64, depending on the material of the lens that is to be trimmed, in order to reduce the contour of the lens roughly to an intermediate shape that is close to but different from that of the desired final contour.

In concrete terms, the control unit selects the roughing wheel 61, 64 by controlling the mobility in pivoting PIV and the translational mobility TRA of the multifunction module 51, so as to bring this roughing wheel 61, 64 to face the edge of the ophthalmic lens L1.

It then commands the movements of retraction ESC and drive ENT in order to cause the rocker 11 and the shafts 12, 13 to pivot jointly so as to machine the ophthalmic lens L1 to the intermediate shape.

Finishing Operations

The finishing operations may themselves be performed in different ways, depending on whether the ophthalmic lens L1 is intended to be mounted on a rimmed, half-rimmed or rimless spectacles frame.

Let us first of all consider the case in which the ophthalmic lens L1 is intended to be mounted on a rimmed spectacles frame.

The finishing operation then consists, in a first step, in machining a nesting rib along the edge of the lens then, in a second step, in chamfering the two sharp cutting edges of the lens.

For the chamfering step, use is made of one or other of the two chamfering wheels 62, 63, depending on the material of the lens that is to be trimmed.

In concrete terms, the control unit for this purpose selects the chamfering wheel 62, 63 by controlling the mobility in pivoting PIV and the translational mobility TRA of the multifunction module 51 so as to bring this chamfering wheel 62, 63 to face the edge of the ophthalmic lens L1.

It then commands the movements of retraction ESC and drive ENT in order to cause the rocker 11 and the shafts 12, 13 to pivot jointly so as to machine the nesting rib to the desired contour.

These two movements ESC, ENT are controlled in coordination with the transfer movement TRA, so that the nesting rib extends along the front optical face of the lens. This transfer movement TRA is then commanded with due regard to the acquired three-dimensional coordinates of the characteristic points of the shape of the projection of the final contour on the front optical face of the lens.

These two movements ESC, ENT are also controlled in coordination with the movement in pivoting PIV, so that the nesting rib has a variable inclination along the edge of the lens, dependent on the curvature of the lens. This movement in pivoting PIV is therefore commanded with due regard to the acquired three-dimensional coordinates of the characteristic points of the shape of the projections of the final contour on the two optical faces of the lens.

For the chamfering step, use is made of the mini chamfering wheel 83.

In concrete terms, the control unit selects one of the two conical parts of the mini chamfering wheel 83 by controlling the mobility in pivoting PIV and the translational mobility TRA of the multifunction module 51 so as to bring this conical part of the mini chamfering wheel 83 to face one of the two sharp edges of the ophthalmic lens L1.

It then commands the movements of transfer TRA, retraction ESC and drive ENT in order to flatten this sharp edge along the entire contour of the lens.

The control unit then selects the other of the two conical parts of the mini chamfering wheel 83 by controlling the mobility in pivoting PIV and the translational mobility TRA of the multifunction module 51 so as to bring this other conical part of the mini chamfering wheel 83 to face the other of the sharp edges of the ophthalmic lens L1.

It then commands the movements of transfer TRA, retraction ESC and drive ENT to flatten this second sharp edge along the entire contour of the lens.

Thus the ophthalmic lens is ready to be mounted in one of the surrounds of the selected rimmed spectacles frame.

Let us consider now the case where the ophthalmic lens L1 is intended to be mounted in a rimless spectacles frame.

The finishing operation then consists, in a first step, in machining the contour of the lens precisely to the desired shape and then, in a second step, in chamfering the two sharp cutting edges of the lens and, finally, in a third step, in drilling the lens.

In order to implement the first step, use is made of the cylindrical zones of one or other of the two chamfering wheels 62, 63 (the grit sizes of which are finer than those of the roughing wheels), depending on the material of the lens to be trimmed.

In concrete terms, the control unit therefore selects the chamfering wheel 62, 63 by controlling the mobility in pivoting PIV and the translational mobility TRA of the multifunction module 51 so as to bring one of the cylindrical zones of this chamfering wheel 62, 63 to face the edge of the ophthalmic lens L1.

As an alternative, if the set of grinding wheels comprises a glass grinding wheel, which means to say a cylindrical grinding wheel, the control unit would then select this glass grinding wheel by controlling the mobility in pivoting and the translational mobility of the multifunction module so as to bring it to face the edge of the ophthalmic lens in order to use it.

The control unit then commands the movements of retraction ESC and drive ENT in order to cause the rocker 11 and the shafts 12, 13 to pivot jointly so as to machine the lens precisely to the desired shape contour.

These two movements ESC, ENT are also controlled in coordination with the movement in pivoting PIV so that the edge of the lens offers an attractive angle of inclination dependent on the curvature of the lens. This movement in pivoting PIV is therefore commanded with due consideration to the acquired three-dimensional coordinates of the characteristic points of the shape of the projections of the final contour on the two optical faces of the lens.

The second step of chamfering is performed in the same way as for an ophthalmic lens intended to be mounted on a rimmed spectacles frame. It will therefore not be described again here.

To perform the third step, use is made of the drill bit 81.

The control unit therefore selects this drill bit 81 by controlling the mobility in pivoting PIV and the translational mobility TRA of the multifunction module 51 so as to bring this drill bit to face a previously identified drill point on the front face of the ophthalmic lens L1.

It also commands the movement of pivoting PIV so as to incline the drill bit as desired with respect to the ophthalmic lens L1, along an axis normal to the plane tangential to the front face of the lens at the drilling point.

It then commands the movements of transfer TRA, retraction ESC and drive ENT in order to drill the lens along this axis normal to the plane tangential to the front face of the lens at the drilling point.

Thus the ophthalmic lens is ready to be mounted on the studs of the selected rimless spectacles frame.

Let us finally consider the case in which the ophthalmic lens L1 is intended to be mounted on a half-rimmed spectacles frame.

The finishing operation then consists, during a first step, in machining the contour of the lens precisely to the desired shape and then, during a second step, in grooving the edge of the lens and finally, during a third step, in chamfering the two sharp cutting edges of the lens.

The first and third steps will then be performed in the same way as for an ophthalmic lens intended to be mounted on a rimless spectacles frame. They will therefore not be described again here.

In order to carry out the second step, use is made of the mini grooving wheel 82 in order to machine a recessed nesting groove along the edge of the lens.

In concrete terms, the control unit for this purpose selects the mini grooving wheel 82 by controlling the mobility in pivoting PIV and the translational mobility TRA of the multifunction module 51 so as to bring this mini grooving wheel 82 to face the edge of the ophthalmic lens L1.

It then commands the movements of retraction ESC and drive ENT in order to cause the rocker 11 and the shafts 12, 13 to pivot jointly so as to groove the edge of the lens.

These two movements ESC and ENT are controlled in coordination with the transfer movement TRA so that the nesting groove extends a constant distance from the front optical face of the lens. This transfer movement TRA is then commanded with due regard to the acquired three-dimensional coordinates of the characteristic points of the shape of the projection of the final contour on the front optical face of the lens.

Thus, the ophthalmic lens is ready to be engaged against one of the bridges of the selected half-rimmed spectacles frame before being held against this bridge by a nylon filament provided for that purpose.

Finally, on completion of these finishing operations, the ophthalmic lens L1 is extracted from between the shafts 12, 13 of the grinding machine 1 using the clamping mobility SER which allows the two shafts 12, 13 to be separated from one another.

The present invention is not in any way restricted to the embodiments described and depicted but a person skilled in the art will know how to apply thereto any alternative form that is in accordance with the spirit thereof.

In particular, provision may be made for the grinding machine to have a different form. Thus it may be arranged in such a way that the pivot axis (A4) of the tool holder is, not orthogonal, but inclined, with respect to the blocking axis (A1).

Moreover, provision may be made for the tool holder to support other tools, such as an engraving tool, a cutter or a milling cutter for example.

The invention claimed is:

1. A trimming device for trimming an ophthalmic lens to be mounted on a spectacles frame, the trimming device comprising:

a rotation blocking and driving assembly configured to block and drive a rotation of the ophthalmic lens about a blocking axis;

a tool holder which carries a first tool configured to rotate a grinding working surface about a rotational axis, a second tool configured to rotate a finishing working surface about a finishing axis, and one of a measurement instrument and a measurement assembly configured to measure a geometry of the ophthalmic lens, the tool holder being configured to move with respect to said blocking and driving assembly with three types of mobility, the three types of mobility including a separation mobility for adjusting a radial separation of said first and second tools from the blocking axis, an offsetting mobility for adjusting an axial position of said first and second tools with respect to said blocking and driving assembly on the blocking axis, and a pivoting mobility about a pivot axis transverse or orthogonal to the blocking axis, for adjusting an orientation of said rotational axis and said finishing axis with respect to said blocking axis, and a controller configured to control the three types of mobility of the tool holder with respect to the blocking and driving assembly, the controller being configured to select the one of the measurement instrument and the measurement assembly or one of the first and second tools by controlling the pivoting mobility of the tool holder with respect to the blocking and driving assembly to bring the one of the measurement instrument and the measurement assembly or the one of the first and second tools into position for measuring or machining the ophthalmic lens, wherein said rotational axis and said finishing axis are distinct axes.

2. The trimming device as claimed in claim 1, wherein the grinding working surface of the first tool has an outside diameter greater than the outside diameter of the finishing working surface of the second tool, projections of the working surfaces of said first and second tools in a plane of projection orthogonal to the finishing axis being at least partially disjointed.

3. The trimming device as claimed in claim 1, wherein said rotational axis and said finishing axis are mutually parallel.

4. The trimming device as claimed in claim 1, wherein said rotational axis and said finishing axis are inclined relative to one another.

5. The trimming device as claimed in claim 1, wherein said first and second tools are driven in rotation respectively about the rotational axis and about the finishing axis by a single motor, at different rotational speeds.

6. The trimming device as claimed in claim 1, wherein said first tool comprises at least one roughing grinding wheel.

7. The trimming device as claimed in claim 1, wherein said first tool comprises at least one finish-grinding wheel.

8. The trimming device as claimed in claim 1, wherein said second tool comprises a grooving wheel and/or a chamfering wheel or a drill bit or a milling cutter.

9. The trimming device as claimed in claim 1, wherein the tool holder and the blocking and driving assembly are mounted with an ability to move on a chassis element.

10. The trimming device as claimed in claim 1, wherein said separation mobility is obtained by a retraction mobility of said blocking and driving assembly with respect to a chassis element about a retraction axis parallel to the blocking axis.

11. The trimming device as claimed in claim 1, wherein the offsetting mobility is a translational mobility of said tool holder with respect to a chassis element along a transfer axis parallel to the blocking axis.

12. The trimming device as claimed in claim 1, wherein said one of the measurement instrument and the measurement assembly comprises a feeler fitted with a feeler tip configured to come to make contact with at least one optical face of the ophthalmic lens.

13. A method for controlling mobility of a tool holder with respect to blocking and driving means of a trimming device configured to trim an ophthalmic lens to be mounted on a spectacles frame, the trimming device including a rotation blocking and driving assembly configured to block and drive a rotation of the ophthalmic lens about a blocking axis, a tool holder which carries:

one of a measurement instrument and a measurement assembly configured to measure a geometry of the ophthalmic lens, a first tool configured to rotate a grinding working surface about a rotational axis, and a second tool configured to rotate a finishing working surface about a finishing axis, said rotational axis and said finishing axis being distinct axes, the tool holder being configured to move with respect to said blocking and driving assembly with three types of mobility, the three types of mobility including:

a separation mobility for adjusting a radial separation of said first and second tools from the blocking axis, an offsetting mobility for adjusting an axial position of said first and second tools with respect to said blocking and driving assembly on the blocking axis, and a pivoting mobility about a pivot axis transverse or orthogonal to the blocking axis, for adjusting an orientation of said rotational axis and said finishing axis with respect to said blocking axis, and a controller configured to control the three types of mobility of the tool holder with respect to the blocking and driving assembly, the controller being configured to select the one of the measurement instrument and the measurement assembly or one of the first and second tools by controlling the pivoting mobility of the tool holder with respect to the blocking and driving assembly to bring the one of the measurement instrument and the measurement assembly or the one of the first and second tools into position for measuring or machining the ophthalmic lens, the method comprising:

selecting a first nose of a feeler by controlling the pivoting mobility and the translation mobility to bring the first nose to face a first optical face of the ophthalmic lens;

measuring a geometry of a first contour situated on said first optical face by coordinated control of the rotation of the ophthalmic lens on the blocking and driving assembly and of the separation mobility of the tool holder;

selecting a second nose of the feeler by controlling the pivoting mobility and translation mobility to bring the second nose to face a second optical face of the ophthalmic lens;

measuring a geometry of a second contour situated on said second optical face by coordinated control of the rotation of the ophthalmic lens the blocking and driving assembly and of the separation mobility of the tool holder;

selecting one of said first and second tools by controlling the pivoting mobility to bring the tool to face an edge face of the ophthalmic lens; and trimming the ophthalmic lens by coordinated control of the rotation of the ophthalmic lens on the blocking and driving assembly and the separation mobility and the offsetting mobility of the tool holder.

14. The method as claimed in claim 13, wherein, during the trimming, the pivoting mobility and the translation mobility of the tool holder is controlled according to the measured geometries of said first and second contours.

* * * * *